United States Patent [19]

Raybon, Jr. et al.

[11] 4,237,187

[45] Dec. 2, 1980

[54] HIGHLY ORIENTED, PARTIALLY DRAWN, UNTWISTED, COMPACT POLY(ε-CAPROAMIDE) YARN

[75] Inventors: James C. Raybon, Jr.; Malcolm O. Darby; Thomas V. Derrick, Jr., all of Columbia, S.C.

[73] Assignee: Allied Chemical Corporation, Morris Township, Morris County, N.J.

[21] Appl. No.: 15,515

[22] Filed: Feb. 26, 1979

[51] Int. Cl.[3] ..... D02G 3/00

[52] U.S. Cl. ..... 428/399; 264/103; 264/176 F; 428/364; 428/373

[58] Field of Search ..... 428/364, 369, 373, 374, 428/375, 395, 399; 264/103, 176 F, 210.8; 28/271, 245, 246; 57/243, 206

[56] References Cited

U.S. PATENT DOCUMENTS

| | | | |
|---|---|---|---|
| 2,161,354 | 6/1939 | Imiray, Jr. et al. | 264/176 F |
| 2,324,397 | 7/1943 | Hull | 264/176 F |
| 2,604,667 | 7/1952 | Hebeler | 264/176 F |
| 2,604,689 | 7/1952 | Hebeler | 428/369 |
| 2,931,068 | 4/1960 | Kitson et al. | 264/345 |
| 2,980,492 | 4/1961 | Jamieson et al. | 264/176 F |
| 2,985,995 | 5/1961 | Bunting, Jr. et al. | 57/204 |
| 3,002,804 | 10/1961 | Kilian | 264/181 |
| 3,084,413 | 5/1963 | Hallden, Jr. | 57/350 |
| 3,091,510 | 7/1963 | McCord et al. | 264/176 F |
| 3,099,064 | 7/1963 | Haynes | 264/168 |
| 3,110,151 | 11/1963 | Bunting, Jr. et al. | 28/271 |
| 3,118,012 | 1/1964 | Kilian | 264/176 F |
| 3,125,793 | 3/1964 | Gonsalves | 28/275 |
| 3,142,147 | 7/1964 | Betsch | 57/246 |
| 3,167,847 | 2/1965 | Gonsalves | 28/275 |
| 3,234,596 | 2/1966 | Sims | 425/72 R |
| 3,258,825 | 7/1966 | Agrett et al. | 28/271 |
| 3,264,389 | 8/1966 | Sims | 264/131 |
| 3,302,386 | 2/1967 | Gonsalves et al. | 57/350 |
| 3,366,721 | 1/1968 | Burdge et al. | 264/129 |
| 3,413,697 | 12/1968 | Agett et al. | 28/221 |
| 3,438,101 | 4/1969 | LeNoir et al. | 28/256 |
| 3,473,315 | 10/1969 | LeNoir | 57/246 |
| 3,563,021 | 2/1971 | Gray | 428/401 |
| 3,568,426 | 3/1971 | Whitley | 428/399 |
| 3,577,615 | 5/1971 | LeNoir | 28/271 |
| 3,823,541 | 7/1974 | Buzano | 57/207 |
| 3,824,776 | 7/1974 | London, Jr. | 57/208 |
| 3,978,558 | 9/1976 | Pike | 28/274 |
| 4,035,464 | 7/1977 | Kubitzek | 264/103 |
| 4,069,562 | 1/1978 | Trifunovic et al. | 28/273 |
| 4,069,564 | 1/1978 | Trifunovic et al. | 28/273 |
| 4,070,817 | 1/1978 | Bueb | 57/908 |
| 4,096,222 | 6/1978 | Bosley | 264/78 |

FOREIGN PATENT DOCUMENTS

| | | |
|---|---|---|
| 483333 | 5/1952 | Canada . |
| 554150 | 3/1958 | Canada . |
| 1678 | 12/1968 | Japan . |
| 1159556 | 7/1969 | United Kingdom . |

*Primary Examiner*—Lorraine T. Kendell

*Attorney, Agent, or Firm*—Virginia S. Andrews; Richard A. Anderson

[57] ABSTRACT

A process for producing a highly oriented, partially drawn, untwisted, compact poly(ε-caproamide) yarn at windup speeds of from 3500 to 6000 meters per minute is disclosed. The process features the steps of overfeeding the yarn, by from 0.5 to 2.0 percent, to entangling means, and overfeeding the shrinking yarn to the winder. The yarn is "drawn" in the quench stack. Draw-twisting is omitted by this process; yarn so produced performs as well as conventional, draw-twisted yarn in end use applications, e.g., knitting and weaving.

1 Claim, 1 Drawing Figure

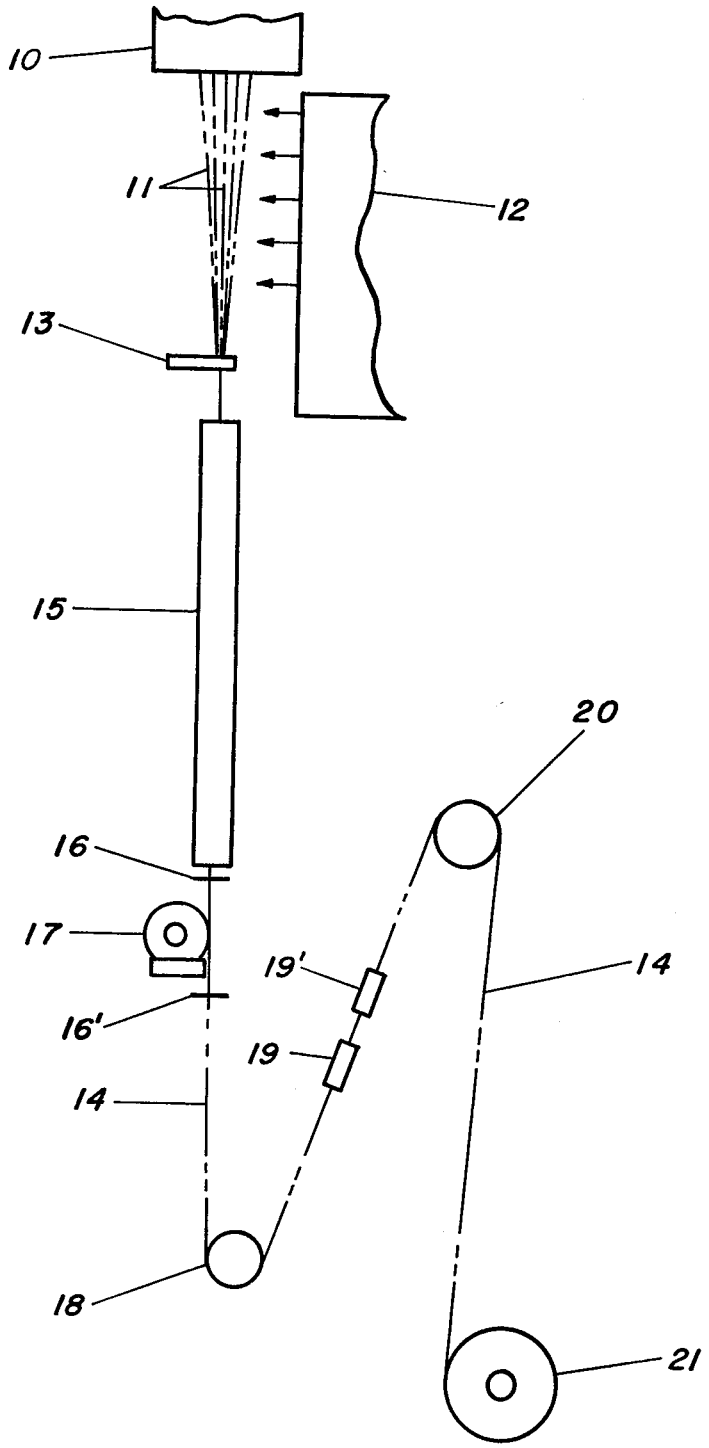
10
11
12
13
15
20
16
17
19'
14
16'
19
14
18
21

HIGHLY ORIENTED, PARTIALLY DRAWN, UNTWISTED, COMPACT POLY(ε-CAPROAMIDE) YARN

BACKGROUND OF THE INVENTION

1. Field of the Invention

The present invention relates to a process for producing a highly oriented, partially drawn, untwisted, compact poly(ε-caproamide) yarn at windup speeds of from 3500 to 6000 meters per minute. More particularly, the invention relates to a process for producing a highly oriented, partially drawn, untwisted, compact poly(ε-caproamide) yarn which includes the steps of overfeeding the yarn to entangling means and overfeeding the shrinking yarn to the winder. Yarn is "drawn" in the quench stack when produced according to this process and has low residual shrinkage to ultimately produce more stable fabric, has low elongation as compared with ordinary undrawn, as-spun yarn to preclude the necessity for further drawing, and is entangled sufficiently to permit knitting of the yarn without a twisting operation. Yarn so produced can be beamed directly from a spin package to obviate the need for a draw-twisting step.

2. Discussion of Prior Art

The high speed spinning of yarn is known. Such a process involves cooling and solidifying a yarn spun from a spinnerette, lubricating the solidified yarn, causing (optionally) the lubricated yarn to pass sequentially over first and second godet rolls, and then winding up the yarn on a spool or package at speeds of at least 2500 meters per minute. U.S. Pat. Nos. 3,996,324 to Landenberger et al. and 4,049,763 to Mineo et al. disclose high speed spinning processes. Yarn produced by such a process is highly oriented, most of the orientation or "draw-down" occurring immediately below the spinnerette and increasing as the spinning speed increases. Further, yarn so produced has a low residual draw ratio, the residual draw ratio decreasing as the spinning speed increases. Highly oriented yarn possessing a low residual draw ratio is usually draw-twisted to produce a yarn suitable for the many common textile operations, e.g., knitting and weaving. This additional, discontinuous step, contributes greatly to manufacturing costs, so it is highly desirable that it be eliminated. It is also known to interlace or entangle yarn to replace twisting of the yarn (see U.S. Pat. No. 3,110,151 to Bunting, Jr. et al.), to ensure compact yarn with adequate handling characterstics. In U.S. Pat. No. 3,110,151, the interlacing is preferably carried out as an adjunct to one or more of the common textile operations, such as spinning and/or drawing, packaging, etc. and further, is generally accomplished by advancing yarn at controlled tension and with zero net overfeed to the fluid interlacer or interlacers described in the patent. In U.S. Pat. No. 3,978,558 to Pike, entangled or interlaced multifilament yarn is produced according to a process which includes overfeeding the yarn from about 0.1 to about 10 percent into an entangling jet with output speeds of from 125 to 1250 yards per minute. Other patents which may be pertinent to the present invention are U.S. Pat. No. 2,161,354 to Imray, Jr. et al., Canadian Pat. No. 554,150 to Hartley, and British Pat. No. 1,159,556 to Hartmann.

SUMMARY OF THE INVENTION

The present invention provides a high speed process for producing highly oriented, partially drawn, untwisted, compact poly(ε-caproamide) yarn. The process comprises the steps of: extruding molten poly(ε-caproamide) polymer at a temperature of between 265° C. and 290° C. through a spinnerette having a plurality of extrusion orifices; solidifying the extruded filaments by advancing them through a quench zone; converging and lubricating the solidified filaments of each end; overfeeding by from 0.5 to 2.0 percent each end of yarn to entangling means; entangling each end of yarn; withdrawing the ends of yarns from the entangling means; overfeeding by from zero to 2.0 percent the ends of yarn to windup means; and winding up each end of yarn at a speed of from about 3500 to 6000 meters per minute.

The preferred process contemplates an extrusion rate of from about 2 to 23 pounds per hour per end, and solidification occurs by advancing the extruded filaments through a quench zone which extends from the spinnerette to just beyond the fiber stick point. The fiber stick point is a dividing line in the yarn path downstream of which filaments will not stick or adhere to a smooth-surfaced rod, such as glass or metal, which is placed within the filament bundle, and upstream of which the filaments will stick or adhere thereto. In the quench zone, a cooling fluid, preferably air, is passed laterally across the path of the filaments at a temperature of between 35° C. and 45° C. and at a volumetric rate of between 90 and 150 cubic feet per minute. It is also preferred that the solidified filaments of each end be substantially simultaneously lubricated and converged. The tension on the yarn at the overfeed to entangling means step is preferably maintained at from 0.05 to 0.40 grams per denier. The number of entanglements per end of yarn will preferably range from 8 to 28 per meter of yarn, as measured by a Rothchild Entanglement Tester R-2050, a modified, speeded up version of the hook drop test.

Throughout the present specification and claims, the term "yarn" indicates strand material including a continuous strand composed of textile fibers or filaments. An "end" is one or a contiguous group of such strands of yarn. By "spinning speed" is meant the speed of the yarn at a point subsequent to complete solidification when no further reduction in denier is observed. A convenient point for determing this speed is the windup region, e.g., winding speed. The process of the preferred embodiment is deemed "cold" in the sense that the only heat applied to the yarn subsequent to extrusion is the slightly heated quenching fluid. In this regard, it should be noted that a decrease in the spinning speed results in decreased orientation until, ultimately, an as-spun, undrawn polyamide yarn with little or no orientation is produced. As-spun polyamide yarn (produced by a "cool" process) tends to crystallize rapidly at room temperature with an accompanying growth in fiber length, thereby rendering stable package formation difficult. A precise spinning speed at which this differentiation between stable and unstable package formation occurs is not capable of definition; however, an accepted turning point is a spinning speed of approximately 3500 meters per minute. This "growth" of the fiber can be minimized and a more stable package formed at spinning speeds under 3500 meters per minute with the addition of heat to the process, for example, in the quench region to retard solidification and thereby impart higher orientation and/or in the takeup region to avoid excessive tension during winding. However, the addition of heat to a process may be economically unjustifiable. The present invention, in its broadest sense, includes both types of processes, i.e., both cold and hot, while in its preferred form, the process is cold. This invention is a high speed take-up process of over 3500 meters/minute. At this speed the yarn being taken up requires overfeed of zero to 2 percent to compensate for shrinkage as the yarn comes off of the last godet roll.

Yarn produced by the process of the present invention may have a denier as high as 400, and is characterized by zero twist, approximately 8 to 28 entanglements per meter of yarn, a residual draw ratio required to produce a yarn with 45 percent elongation of at most about 1.3, an elongation at break of between about 45 and 70 percent, a boil shrinkage (at 100° C.) of approximately 7 to 8 percent, and a tenacity of between 3.8 and 4.6 grams per denier. Beaming and knitting performance levels of the yarn are generally comparable or better than the same or similar denier as-spun yarn which has been draw-twisted. At high spinning speeds, such as at about 6,000 m/m, the residual draw ratio would be 0 percent and elongation 45 percent, or less.

The lower denier, e.g., 40 and 80 denier, yarn can be knitted into tricot fabrics such as lingerie or into fleece fabrics such as robes, athletic wear, and upholstery. The higher denier, e.g., 200 and 400 denier, yarn can be woven into fabric for such uses as knapsacks, windbreakers, garment bags, athletic shoe uppers, and canvas sacks. The weaving and knitting of the yarn can take place without twisting or additional drawing, although these operations may be performed if desired depending on end use.

DESCRIPTION OF THE DRAWING

The accompanying drawing shows schematically the apparatus utilized in carrying out the process of the present invention.

DESCRIPTION OF THE PREFERRED EMBODIMENT

Referring to the accompanying drawing, a large number of filaments 11 are spun from a conventional spinnerette or spinnerettes 10 having a plurality of orifices into a quench zone where they are cooled by a cross-flow of quenching fluid, preferably air, at a temperature of preferably between 35° C. and 45° C. and a volumetric rate of between, preferably, about 90 and 150 cubic feet per minute (hereafter CFM), supplied by quench cabinet 12. Spin head temperatures may vary, 265° C. to 290° C. being preferred. The individual filaments of yarn can have any cross-sectional configuration such as round, oval, heart-shaped, hollow, Y-shaped, multilobal, polygonal, or mixtures thereof.

Subsequent to their solidification, i.e., below their fiber stick point, filaments 11 are converged into one or more filament bundles or ends 14 and lubricated. In the most preferred embodiment, convergence and lubrication of filaments 11 occur simultaneously at lubricating device 13, such as a metered finish guide, prior to passage of yarn ends 14 through interfloor tube 15. This early convergence system minimizes potential increase in yarn tension due to frictional resistance of air caused by air dragging on the yarn at the high speed of the solidified filaments 11 as the ends pass through interfloor tube 15. Yarn ends 14 pass from interfloor tube 15 through one or more finger guides 16 and in partial wrap around first godet roll 18 and thence into entangling jet 19 or jets 19 and 19' in series. From there, yarn ends 14 are advanced in partial wrap about second godet roll 20 to be wound up by winder 21 at a speed of between 3500 and 6000 meters per minute.

The diameters of first 18 and second 20 godet rolls and the speed at which they are driven are chosen so as to produce an overfeed of from 0.5 to 2.0 percent of the yarn to the entangling jet 19 or jets 19 and 19'. A higher degree of overfeed will result in yarn end slippage on the second godet roll. Lower overfeed yields fewer entanglements in the yarn than desirable. Yarn ends 14 are also overfed by from 0 to 2.0 percent to winder 21 from second godet roll 20. This latter overfeed compensates for shrinkage of the yarn as it leaves the final godet roll 20.

In an alternative embodiment, lubricating device 13 is omitted, and filaments 11 pass from the quench zone through interfloor tube 15 to be converged into one or more yarn bundles or ends 14 at first finger guide 16. Yarn ends 14 then are lubricated at lubricating device 17 (depicted as a kiss roll), passed through second finger guide 16' and on to first godet roll 18 as previously described.

The entangling means is preferably an entangling jet 19 or jets 19 and 19' in series, which entangle each end of yarn under air pressure of preferably 100 to 120 psig, the jet air passing perpendicular to the yarn path and centered thereon. The number of entanglements produced is approximately 8 to 28 per meter of yarn. Entanglement is random and prevents separation of the yarn filaments in an end along its length for any substantial distance during knitting or weaving operations. The number of entanglements is ascertained by a Rothchild Entanglement Tester R-2050.

The following specific examples are given to illustrate the present invention and are not to be considered as limiting the scope of the invention.

EXAMPLE 1

Nylon 6 was extruded at a temperature of 270° C. and at a rate of about 2.2 pounds per hour per end through two spinnerettes having 12 Y-shaped orifices each. The filaments 11 leaving the spinnerettes 10 were taken off at a spinning speed of 3800 meters per minute and advanced through a quench zone to be cooled by a cross-flow of air supplied by quench cabinet 12 at a temperature of about 41.5° C. and at a volumetric rate of 105 CFM. Quench cabinet 12 had a length of about 2.74 meters (about 9 feet). From the cooling zone, filaments 11 were advanced through interfloor tube 15 having a length of about 3.05 meters (about 10 feet), through finger guide 16 which separated and converged filaments 11 into two bundles or ends 14 of 12 filaments each, to contact tangentially lubricating device 17 (depicted as a kiss roll) which applied a sufficient amount of finish to retain about 0.8 to about 1.0 percent by weight based on the weight of the yarn. Yarn ends 14 were then passed through finger guide 16' and in partial wrap around first godet roll 18 having a diameter of about 15.23 centimeters (about 5.995 inches) and into a single entangling jet 19, which entangled each yarn end at a yarn tension of about 15 grams under air pressure of about 120 psig, the jet air passing perpendicular to the yarn path and centered thereon. Yarn ends 14 were then withdrawn from entangling jet 19 and passed in partial wrap around second godet roll 20 having a diameter of about 15.00 centimeters (about 5,905 inches) to be wound up by winder 21 at a speed of 3800 meters per minute. Each end 14 of filaments 11 had a denier of 40.

The first 18 and second 20 godet rolls were driven at the same speed to produce an overfeed of about 1.5 percent to entangling jet 19. The tension of the yarn between second godet roll 20 and winder 21 was about 18 grams. There was 1.6 percent overfeed from second godet roll 20 to winder 21. Properties of the yarn so produced and some process parameters are set forth in Table I.

EXAMPLE 2 (COMPARATIVE)

By way of comparison with Example 1, four ends of 12 filaments of nylon 6 yarn having a denier per end of approximately 38.8 were similarly extruded at a temperature of about 279° C. and at a rate of about 1.35 pounds per hour per end from four spinneretes having round orifices, cooled by a cross-flow of air supplied at a temperature of about 41.5° C. and at a volumetric rate of 85 CFM, passed through interfloor tube 15, passed through finger guide 16, contacted by two lubricating devices 17 in series, passed through finger guide 16' and in partial wrap over first 18 and second 20 godet rolls (having different diameters and being driven at the same speed so as to result in a stretch of 1.7 percent) to be wound by winder 21 at a speed of 800 meters per minute. The second godet roll 20 and winder 21 were driven at different speeds so as to produce a further stretch of about 1 percent. At this point, the yarn was characterized by an elongation of approximately 350 to 400 percent. The yarn was then creeled in a conventional drawtwister. The yarn was passed over a feed roll to a draw roll and subsequently taken up on a spindle which applied 0.3 twists per inch. The feed and draw rolls were of different diameters and driven at different speeds in order to produce a draw ratio of approximately 3.27 to 1. No heat was applied to initiate drawing. Properties of the yarn so produced and some process parameters are set forth in Table 1.

EXAMPLE 3

Nylon 6 was extruded at a temperature of about 270° C. and at a rate of about 2.64 pounds per hour per end through four spinnerettes having 12 round-shaped orifices each. The filaments were taken off at a spinning speed of 4500 meters per minute and advanced through a quench zone to be cooled by a cross flow of air supplied by quench cabinet 12 at a temperature of about 41.5° C. and at a volumetric rate of 150 CFM. Quench cabinet 12 had a length of about 2.74 meters (about 9 feet), and lubricating device 13 was located about 1.02 meters (about 40 inches) upstream of the base of quench cabinet 12. Lubricating device 13 comprised 4 conventional metered finish applicators, slightly staggered and with V-shaped applicator slots. Filaments 11 were converged into four bundles or ends 14 or 12 filaments each and simultaneously lubricated by the metered finish applicators to retain about 0.7 to about 0.9 percent by weight based on the weight of the yarn. Ends 14 then were advanced through interfloor tube 15 having a length of about 3.05 meters (about 10 feet), through finger guide 16 and in partial wrap around first godet roll 18 and into a single entangling jet 19 which entangled each yarn end at a yarn tension of about 15 grams under air pressure of about 120 psig, the jet air passing perpendicular to the yarn path and centered thereon. Yarn ends 14 where then withdrawn from entangling jet 19 and passed in partial wrap around second godet roll 20 to be wound up by winder 21 at a speed of 4500 meters per minute. Each end 14 of filaments 11 had a denier of 40.

The first 18 and second 20 godet rolls had identical diameters but were driven at different speeds to produce an overfeed of about 1.5 percent to entangling jet 19. The tension of the yarn between second godet roll 20 and winder 21 was about 10 grams. There was 1.1 percent overfeed from second godet roll 20 to winder 21. Properties of yarn so produced and some process parameters are set forth in Table 1.

EXAMPLE 4

Example 3 was repeated with the following process changes: An extrusion rate of 2.94 pounds per hour per end; entanglement at a yarn tension of about 15 grams; 1.7 percent overfeed from second godet roll 20 to winder 21; and takeup speed of 5,000 meters per minute. Properties of yarn so produced and some process parameters are set forth in Table 1.

EXAMPLE 5

Example 4 was repeated utilizing tandem entangling jets 19 and 19' (in series) with center to center spacing of approximately 6.35 centimeters (2.5 inches). Properties of yarn so produced and some process parameters are set forth in Table 1.

EXAMPLE 6

Example 1 was repeated with the following changes: The product was 80 denier, 24 filaments per end, two ends, 12 orifices per spinnerette (four); extrusion rate of 4.46 pounds per hour per end; entanglement at a yarn tension of about 20 grams; jet air pressure of 100 psig; overfeed from second godet to winder of approximately 1.5 percent. The tension of the yarn between second godet roll 20 and winder 21 was about 20 grams. Properties of yarn so produced and some process parameters are set forth in Table 2.

EXAMPLE 7 (COMPARATIVE)

For comparison with Example 6, Example 2 was repeated with the following changes: The product was 80 denier, 24 filaments per end, four ends, 24 orifices per spinnerette, extrusion rate of 2.96 pounds per hour per end. The as-spun yarn was characterized by residual draw ratio of about 3.33 and an elongation of about 350 to 400 percent. The yarn was then creeled in a conventional drawtwister. The yarn was passed over a feed roll to a draw roll and subsequently taken up on a spindle which applied 0.3 twists per inch. The feed and draw rolls were of different diameters and driven at different speeds in order to produce a draw ratio of about 3.33 to 1. No heat was applied to initiate drawing. Properties of yarn so produced and some process parameters are set forth in Table 2.

EXAMPLE 8

Example 1 was repeated with the following changes: The product was 200 denier, 32 filaments per end, two ends, 16 orifices per spinnerette (four), extrusion rate of 11.16 pounds per hour per end; entanglement at a yarn tension of about 20 grams; jet air pressure of 100 psig; overfeed from second godet roll to winder of about 0.8 percent. The tension of the yarn between second godet roll 20 and winder 21 was about 35 grams. Properties of yarn so produced and some process parameters are set forth in Table 3.

EXAMPLE 9 (COMPARATIVE)

For comparison with Example 8, Example 2 was repeated with the following changes: The product was 200 denier, 32 filaments per end, two ends, 16 round-shaped orifices per spinnerette, an extrusion rate of 7.43 pounds per hour per end. The as-spun yarn was characterized by a residual draw ratio of about 3.40 and an elongation of about 350 to 400 percent. The yarn was then creeled in a conventional drawtwister. The yarn was passed over a feed roll to a draw roll and subsequently taken up on a spindle which applied 0.3 twists per inch. The feed and draw rolls were of different diameters and driven at different speeds in order to produce a draw ratio of about 3.40 to 1. No heat was applied to initiate drawing. Properties of yarn so produced and some process parameters are set forth in Table 3.

EXAMPLE 10

Example 1 was repeated with the following changes: The product was 400 denier, 64 filaments per end, one end, 16 round-shaped orifices per spinnerette (four), an extrusion rate of 22.32 pounds per hour per end; entanglement at a yarn tension of about 28 grams; jet air pressure of 100 psig; overfeed from second godet to winder of about 1.0 percent. The tension of the yarn between second godet roll 20 and winder 21 was about 38 grams. Properties of yarn so produced and some process parameters are set forth in Table 3.

DISCUSSION

Reference to Table 1 illustrates the improved quality of 40 denier yarn produced according to Examples 1 and 3 of the present invention as compared with the draw-twisted yarn of Example 2. In particular, note the improved boil shrinkage, and beaming and knitting performances. During beaming operations, defective yarn ends are detected and counted by a Lindly Photoelectric Sensing Unit. The number of defects per million end yards is calculated by dividing the number of defects by the number of end yards monitored (expressed in millions). End yards is the product of the number of yarn ends being monitored multiplied by the number of yards. Knitting performance is expressed in terms of an average number of racks per defect occurrence. The higher percent elongation of Examples 1, 3, 4 and 5 as compared with Example 2 does not adversely affect yarn quality for purposes of subsequent knitting and weaving. The poorer beaming and knitting performances of Examples 4 and 5 as compared with Example 2 are primarily attributable to the high spinning speed. The use of two entangling jets in series (compare Example 5 with Example 4) improves the knitting performance. The slightly poorer beaming and knitting performances of these two examples as compared with Example 2 is more than offset by the added expense in Example 2 of the separate draw-twisting operation. Other measured yarn physical properties are well within acceptable limits.

With respect to Table 2, the quality of 80 denier yarn produced according to Example 6 of the present invention is also improved when compared with the draw-twisted yarn of Example 7. In particular, note the improved boil shrinkage, and beaming and knitting performances. All other measured yarn physical properties are well within acceptable limits.

With respect to Table 3, quality of 200 denier yarn produced according to Example 8 of the present invention is comparable to the draw-twisted yarn of Example 9. Reference to Example 10 will show that the beaming performance is much worse for a 400 denier yarn; however, the yarn physical properties of this example are still well within acceptable limits.

Better beaming and knitting performance and increased entanglements may be obtained through use of Stantex 1840 (manufactured by Standard Chemical Co.) as the spin finish.

TABLE 1

| Example | 1 | 2 | 3 | 4 | 5 |
|---|---|---|---|---|---|
| Denier | 40 | 38.8 | 40 | 40 | 40 |
| Number of Filaments Per End | 12 | 12 | 12 | 12 | 12 |
| Draw-Twisted | No | Yes | No | No | No |
| Entangling Jet(s) | 1 | No | 1 | 1 | 2 |
| Elongation (%) | 61 | 45 | 61 | 60 | 60 |
| Tenacity (grams/denier) | 3.8 | 5.2 | 4.4 | 4.6 | 4.6 |
| Uster | 2.2 | 3.1 | 3.2 | 3.6 | 3.6 |
| Boil Shrinkage (%) at 100° C. | 7–8 | 14 | 7–8 | 7–8 | 7–8 |
| Entanglements/Meter | 18 | 0 | 18 | 9 | 12 |
| Residual Draw Ratio (required to produce a yarn with 45% elongation) | 1.2 | 0 | 1.2 | 1.2 | 1.2 |
| Beaming Performance (defects/million end yards) | 0.12 | 0.25 | 0.14 | 0.4 | 0.4 |
| Knitting Performance (racks/defect) | 600 | 350 | 400 | 68 | 138 |
| Spinning speed (meters/minute) | 3800 | 800 | 4500 | 5000 | 5000 |

TABLE 1

| Example | 6 | 7 |
|---|---|---|
| Denier | 80 | 80 |
| Number of Filaments Per End | 24 | 24 |
| Draw-Twisted | No | Yes |
| Entangling Jet(s) | 1 | No |
| Elongation (%) | 62 | 45 |
| Tenacity (grams/denier) | 4.0 | 5.2 |
| Uster | 2.4 | 3.4 |
| Boil Shrinkage (%) at 100° C. | 7–8 | 15 |
| Entanglements/Meter | 18 | 0 |
| Residual Draw Ratio (required to produce a yarn with 45% elongation) | 1.2 | 0 |
| Beaming Performance (defects/million end yards) | 0.28 | 0.3 |
| Knitting Performance (racks/defect) | 579 | 150 |
| Spinning Speed (meters/minute) | 3800 | 800 |

TABLE 3

| Example | 8 | 9 | 10 |
|---|---|---|---|
| Denier | 200 | 200 | 400 |
| Number of Filaments Per End | 32 | 32 | 64 |
| Draw-Twisted | No | Yes | No |
| Entangling Jet(s) | 1 | No | 1 |
| Elongation (%) | 62 | 43 | 69 |
| Tenacity (grams/denier) | 4.11 | 4.6 | 4.3 |
| Uster | 2.3 | 2.7 | 2.6 |
| Boil Shrinkage (%) at 100° C. | 7–8 | 15 | 7–8 |
| Entanglements/Meter | 14 | 0 | 9 |
| Residual Draw Ratio (required to produce a yarn with 45% elongation) | 1.2 | 0 | 1.3 |
| Beaming Performance (defects/million end yards) | 0.33 | 0.25 | 1.7 |
| Knitting Performance (racks/defect) | Woven | Woven | Woven |
| Spinning Speed | | | |

TABLE 3-continued

| Example | 8 | 9 | 10 |
|---|---|---|---|
| (meters/minute) | 3800 | 800 | 3800 |

What is claimed is:

1. A highly oriented-as-spun, partially drawn, untwisted, compact, interlaced multifilament poly(ε-caproamide) yarn characterized by a denier as high as 400, approximately 8 to 28 entanglements per meter of yarn, a residual draw ratio required to produce a yarn with 45 percent elongation of at most 1.3, an elongation at break of between about 45 and 70 percent, a boil shrinkage at 100° C. of approximately 7 to 8 percent, and a tenacity of about 3.8 to 4.6 grams per denier.

* * * * *